US005501051A

United States Patent [19]

Harlan

[11] Patent Number: 5,501,051

[45] Date of Patent: Mar. 26, 1996

[54] PORTABLE DISPLAY FRAME WITH TELESCOPING SUPPORT BARS

[75] Inventor: Jeffrey Harlan, Alta Loma, Calif.

[73] Assignee: Professional Displays, Inc., Covina, Calif.

[21] Appl. No.: 262,996

[22] Filed: Jun. 20, 1994

[51] Int. Cl.[6] ..... E04H 12/18

[52] U.S. Cl. ..... 52/646; 52/239; 160/135

[58] Field of Search ..... 160/135, 351; 52/646, 645, 64, 239; 40/606, 610; 211/189, 182

[56] References Cited

U.S. PATENT DOCUMENTS

| | | | |
|---|---|---|---|
| 88,123 | 3/1869 | Boughner . | |
| 404,636 | 6/1889 | Levy . | |
| 526,135 | 9/1894 | Stone . | |
| 892,413 | 7/1908 | Freeman . | |
| 2,187,870 | 10/1939 | Veccia . | |
| 4,471,548 | 9/1984 | Goudie | 52/646 X |
| 4,658,560 | 4/1987 | Beaulieu . | |
| 4,809,471 | 3/1989 | Wichman et al. | 52/646 X |
| 4,888,895 | 12/1989 | Kemeny | 52/646 X |
| 4,942,686 | 7/1990 | Kemeny | 52/646 X |
| 5,203,126 | 4/1993 | Sorenson et al. | 52/646 X |
| 5,203,134 | 4/1993 | Sorenson et al. | 52/646 |

*Primary Examiner*—David M. Purol

[57] ABSTRACT

A portable display frame combination is claimed which provides a display combination which is easy and quick to assemble, sturdy and portable. The combination comprises a support frame, a plurality of support devices attached vertically to the display frame and a plurality of display panels attached to the support devices. The support devices are each comprised of a plurality of individual bars which telescope into one another for ease of storage and transport. As the bars are telescopically expanded, unique connection pieces cause each of the inner bars to snap forward to provide a smooth support surface disposed in a single plane. The connection pieces are made up of a forward section and a rearward section, the rearward section is affixed to one end of the inner bar. The forward section is separated from the rearward section by a spring in such a way that the forward section can be compressed toward the rearward section by applying pressure to the forward section. The forward section has a first portion which is affixed flush with the inner bar and a second section which is recessed from the first section by a distance equal to the thickness of the wall of the outer bar. As the inner bar is drawn out of the outer bar, the spring causes the forward section to snap forward so that the inner bar and the first section of the connection device are flush with the outer bar.

20 Claims, 3 Drawing Sheets

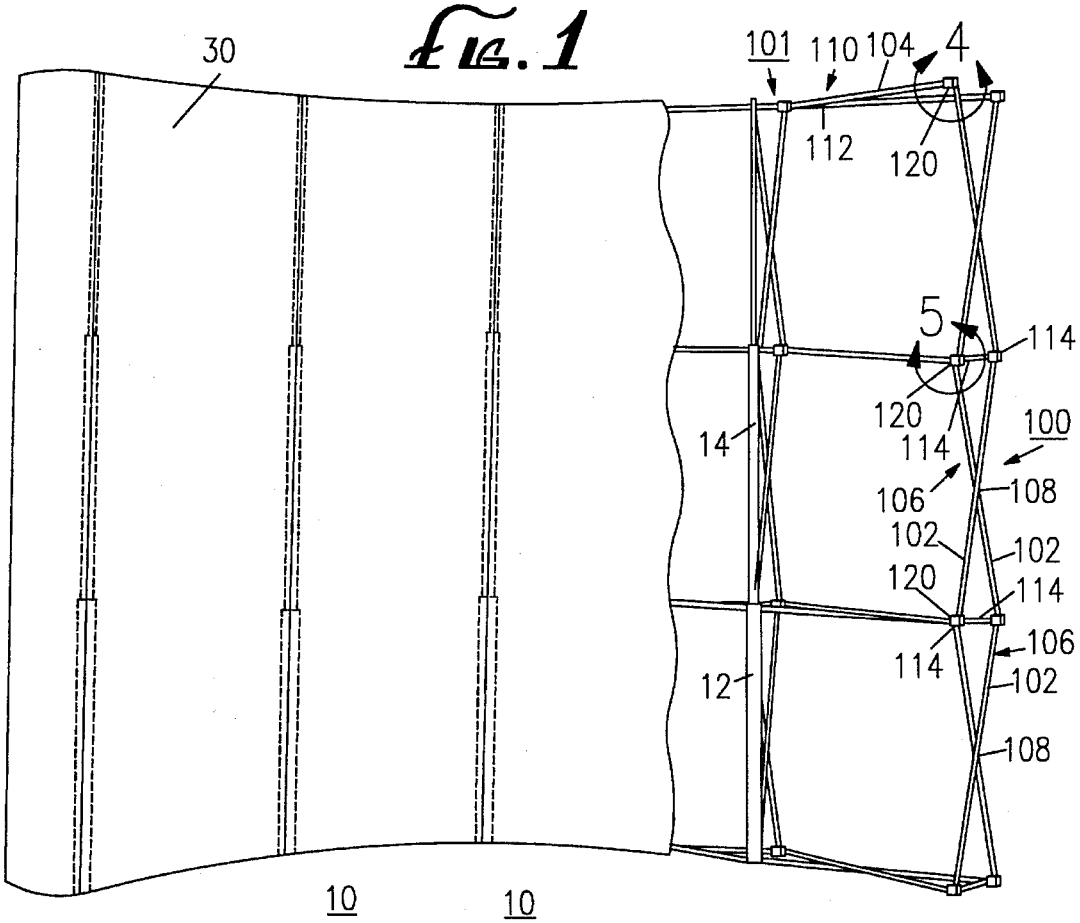
FIG. 1
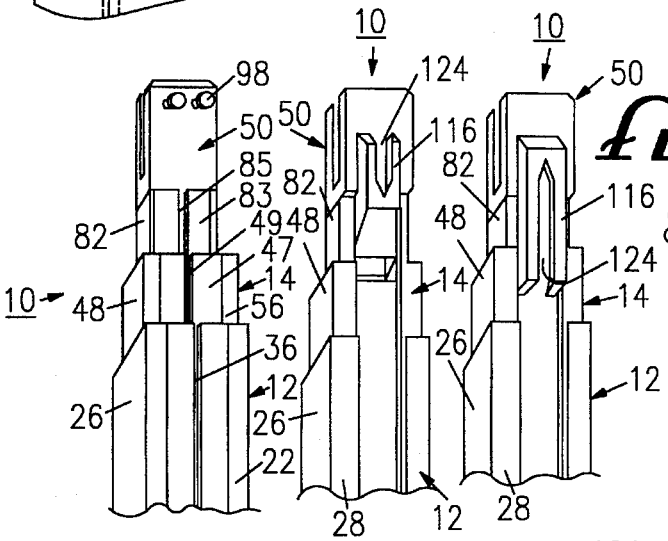
FIG. 2
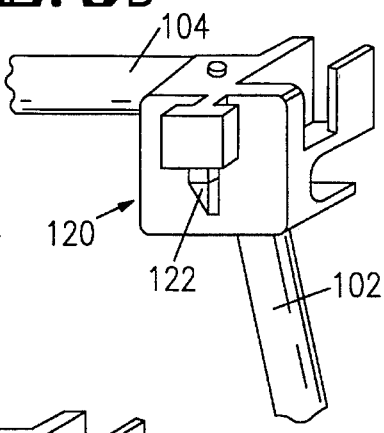
FIG. 3B
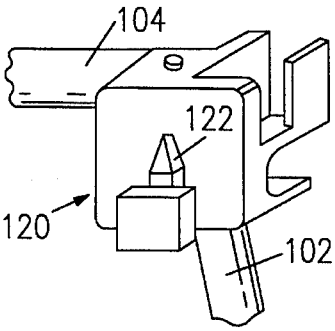
FIG. 3A
FIG. 4A
FIG. 4B

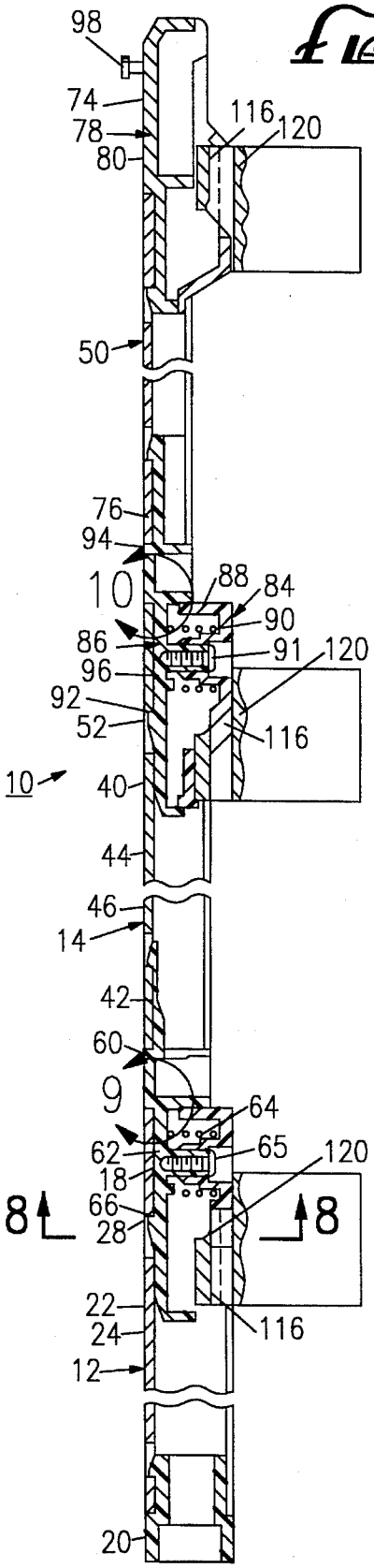
FIG. 6A
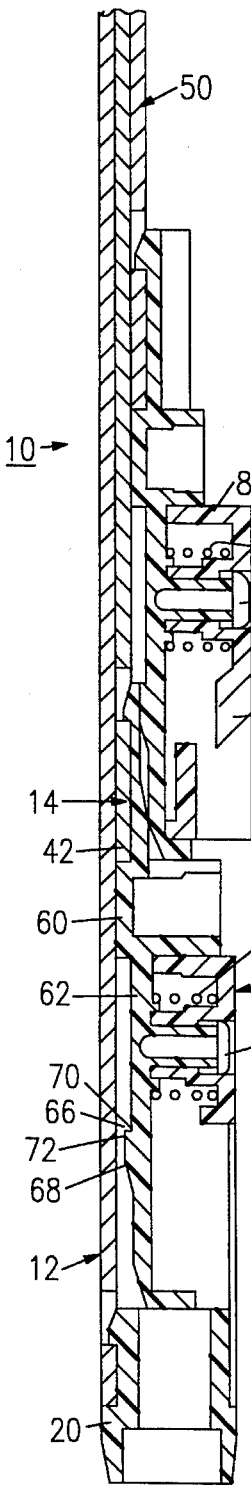
FIG. 5
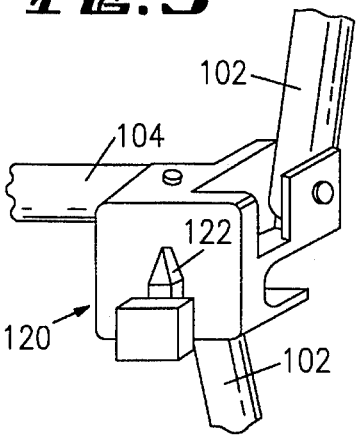
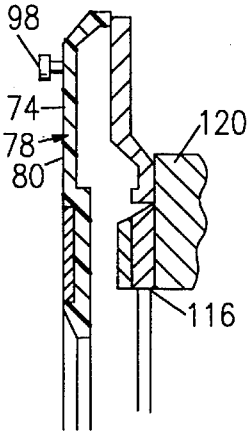
FIG. 6B
FIG. 7

PORTABLE DISPLAY FRAME WITH TELESCOPING SUPPORT BARS

FIELD OF THE INVENTION

This invention relates generally to support frames for retaining planar panels and, specifically, to portable support frames for retaining display boards.

BACKGROUND OF THE INVENTION

Portable display frames for retaining display boards used in business presentations, trade shows and other commercial activities have become very popular. Such display frames allow a business person to quickly and easily construct a very professional looking display presentation using materials which are easily portable by automobile, airplane and other convenient modes of transportation. The utility of such portable display frames is directly related to the sturdiness of the frame, the ease and speed of its assembly, and its lightweight. A salesman, for example, making a presentation for a customer cannot afford to employ helpers to transport and assemble such a frame, nor can such a salesman afford to spend an inordinate amount of time assembling the frame. Moreover, if the frame gives the appearance of flimsiness after assembly, the salesman's resulting presentation will be adversely affected. Accordingly, there is an ever-present need for a portable display frame which is more sturdy and is more easily assembled than prior art display frames without being more costly or any less portable than prior art display frames.

SUMMARY

The invention satisfies this need. The invention is a support device useful for attaching panel boards to a portable display frame comprising:

(a) an elongate first bar having a proximal end, a distal end, a forward wall with a flat outer surface and a thickness t, a pair of opposing sidewalls, and a lip disposed on the proximal end;

(b) an elongate second bar configured and dimensioned to be slidably disposed and retained within the first bar, the second bar having a proximal end, a distal end, a forward wall with a flat outer surface and a pair of opposing side walls; and (c) a first connection piece attached to the distal end of the second bar comprising:

(i) a forward moiety affixed to the distal end of the second bar and a rearward moiety displaceably attached to the rearward moiety, the forward moiety having a first forward surface section disposed flush with the outer surface of the forward wall of the second bar and a second forward surface section disposed distal to the first forward surface section and in a parallel plane with that of the first forward surface section but recessed therefrom by a distance substantially equal to t;

(ii) a compressible spacer disposed between the forward and rearward moieties and configured and dimensioned to urge the forward moiety away from the rearward moiety; and (iii) a catch disposed on the second forward surface section, the catch being configured and dimensioned to (I) engage the lip on the proximal end of the first bar when the device is telescopically expanded, and (II) not engage the lip on the proximal end of the first bar when the device is telescopically contracted;

so that the second bar can be telescopically expanded out of the first bar in such a way that the outer surface of the forward wall in the first bar is flush with both the first forward surface section of the first connection piece and the outer surface of the forward wall in the second bar; and so that the second bar can be telescopically contracted into the first bar by depressing the forward moiety of the first connection piece against the force exerted by the compressible spacer and then sliding the first connection piece and the second bar into the first bar.

In a typical embodiment, the support device has at least three telescoping bars. Each pair of adjoining bars are connected together by a connection piece analogous to the first connection piece.

The support device is ideal for supporting display panel boards on a support frame. In such embodiments, the support frame has attachment hubs and the support device has corresponding attachment components.

DESCRIPTION OF DRAWINGS

These and other features, aspects and advantages of the present invention will become better understood with reference to the following description, appended claims and accompanying drawings where:

FIG. 1 is a perspective drawing of a display panel combination having features of the invention;

FIG. 2 is a perspective detailed drawing of a support device having features of the invention;

FIG. 3*a* is a detailed perspective drawing showing the reverse side of the support device illustrated in FIG. 2;

FIG. 3*b* is a detailed perspective drawing showing an alternative reverse side of the support device illustrated in FIG. 2;

FIG. 4*a* is a detailed perspective drawing of an upper hub useful in the invention;

FIG. 4*b* is a detailed perspective drawing of an alternative upper hub useful in the invention;

FIG. 5 is a detailed perspective view of a intermediate hub useful in the invention;

FIG. 6*a* is a cross-sectional side view of a support device having features of the invention showing this support device in a fully expanded mode;

FIG. 6*b* is a cross-sectional side view of one end of an alternative support device having features of the invention;

Figure 8:
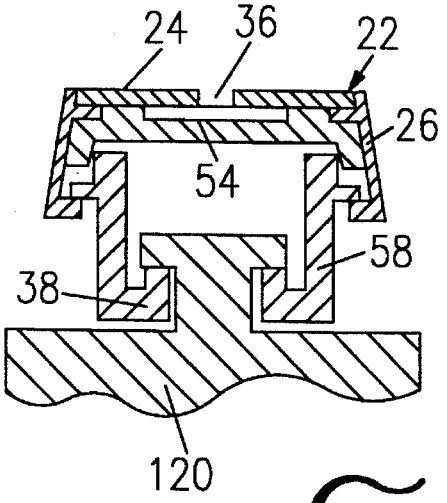
Figure 9:
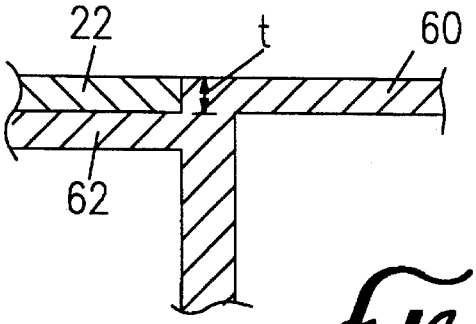
Figure 10:
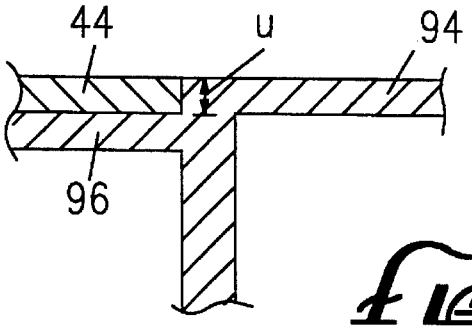

FI. 7 is a cross-sectional side view of the support device illustrated in FIG. 6 showing the support device in a fully retracted mode;

FIG. 8 is a cross-sectional front view of the support device of FIG. 6 taken along line 8—8;

FIG. 9 is a detail cross-sectional side view showing the interaction of the proximal end of the first bar with the first connection piece; and FIG. 10 is a detail cross-sectional side view showing the interaction of the proximal end of the second bar with the second connection piece.

DETAILED DESCRIPTION OF THE INVENTION

The invention is a support device 10 comprising an elongate first bar 12, a telescoping elongate second bar 14 and a first connection piece 16.

The first bar 12 has a proximal end 18, a distal end 20, a forward wall 22 with a flat outer surface 24 and a thickness t, a pair of opposing sidewalls 26 and a lip 28 disposed on the proximal end 18.

The forward wall 22 has a flat outer surface 24 so that it can be used to support a planar display board 30. In a preferred embodiment, the forward wall 22 is magnetized so that it can hold into place a display panel board 30 having matching magnetic strips or ferris material strips. As shown in FIG. 8, the forward wall 22 can be bifurcated into two parallel strips separated by a groove 36. It has been found that such a configuration assists in the smooth telescoping action of an inner bar within an outer bar. The groove 36 apparently forms a reservoir of air which provides an air cushioning effect as two telescoping bars slide relative to one another.

The lip 28, which is disposed on a proximal end 18 of the first bar 12, can be provided by a slit or an aperture on the first bar 12, as shown in the drawings.

The sidewalls 26 can be made of any light suitable material, such as a light metal or plastic. Aluminum has been found to be a useful material of construction for the sidewalls 26. In the embodiment shown in the drawings, each sidewall 26 has a small flange 38 useful for retaining the second bar 14 within the first bar 12.

The distal end 20 of the first bar 12 can be left open or it can be enclosed. The proximal end 18 of the first bar 12 is left open to allow the second bar 14 to slide into and out of the first bar 12.

The second bar 14 also has a proximal end 40, a distal end 42, a forward wall 44 with a flat outer surface 46 and a pair of opposing sidewalls 48. The thickness of the forward wall 44 is u. The second bar 14 is configured and dimensioned to be slidably disposed and retained within the first bar 12. For aesthetic and utility reasons, the second bar 14 is generally made out of the same materials as the first bar 12.

The forward wall 44 has a flat outer surface 46 so that it can be used to support a planar display board 30. The forward wall 44 can be comprised of two layers, a support layer (not shown) and a facing layer 47. The support layer can be integral with the sidewalls 48. The facing layer 47 is applied to the exterior of the support layer to form the smooth flat forward surface 46. Like the first bar, in a preferred embodiment of the second bar, the facing layer 47 is magnetized so that it can hold into place a display panel board 30 having matching magnetic strips or ferris material strips. The facing layer 47 can be bifurcated into two parallel strips separated by a groove 49. It has been found that such a configuration assists in the smooth telescoping action of an inner bar within an outer bar. The groove 49 apparently forms a reservoir of air which provides an air cushioning effect as two telescoping bars slide relative to one another.

In embodiments employing a third bar 50 (discussed below), the second bar 14 further comprises a lip 52 disposed on the proximal end 40 of the second bar 14 and the opposing sidewalls 48 of the second bar 14 each have an inwardly directed flange (not shown) to retain the third bar 50.

The first bar 12 and the second bar 14 are connected together by the first connection piece 16. The first connection piece 16 has a forward moiety 56 affixed to the distal end 42 of the second bar 14 and a rearward moiety 58 which is displaceably attached to the forward moiety 56 of the second bar 14. The forward moiety 56 of the second bar 14 has a first forward surface section 60 disposed flush with the outer surface 46 of the forward wall 44 of the second bar 14 and a second forward surface section 62 disposed distal to the first forward surface section 60 and in a parallel plane with that of the first forward surface section 60 but recessed therefrom by a distance substantially equal to t.

A compressible spacer 64 is disposed between the forward and rearward moieties 56 and 58. The compressible spacer 64 is configured and dimensioned to urge the forward moiety 56 away from the rearward moiety 58. The compressible spacer 64 can be a spring, such as coil spring. A bolt 65 or other fastener can be used to hold the forward moiety 56 to the rearward moiety 58.

A catch 66 is disposed on the second forward surface section 62. The catch 66 is configured and dimensioned to engage the lip 28 on the proximal end 18 of the first bar 12 when the device 10 is telescopically expanded. The catch 66 is also configured and dimensioned to not engage the lip 28 on the proximal end 18 of the first bar 12 when the device 10 is telescopically contracted. In the embodiments shown in the drawings, the catch 66 is a flange having a tapered distal edge 68 and an engageable proximal edge 70. By the term "engageable," it is meant that the proximal edge 70 is configured so as to be retained by the lip 28 on the proximal end 18 of the first bar 12 when the device 10 is telescopically expanded. The proximal edge 20 can terminate at a substantially sharp corner 72 which is capable of engaging the lip 28. For such embodiments, it is important that the proximal edge 70 does not taper in the proximal direction (or the corner 72 will not engage the lip 28).

By the above-described configurations of the first bar 12, the second bar 14 and the first connection piece 16, the second bar 14 can be telescopically expanded out of the first bar 12 in such a way that the outer surface 24 of the forward wall 22 in the first bar 12 is flush with both the first forward surface section 60 of the first connection piece 16 and the outer surface 46 of the forward wall 44 in the second bar 14. Also, the second bar 14 can be telescopically contracted into the first bar 12 by depressing the forward moiety 54 of the first connection piece 16 against the force exerted by the compressible spacer 64 and then sliding the first connection piece 16 and the second bar 14 into the first bar 12.

In the embodiment shown in the drawings, the support device 10 further comprises a third bar 50 configured and dimensioned to be slidably disposed and retained within the second bar 14. Like the first and second bars 12 and 14, the third bar 50 has a proximal end 74, a distal end 26, a forward wall 28 with a flat outer surface 80 and a pair of opposing sidewalls 82.

The forward wall 78 has a flat outer surface 80 so that it can be used to support a planar display board 30. The forward wall 78 can be comprised of two layers, a support layer (not shown) and a facing layer 83. The support layer can be integral with the sidewalls 82. The facing layer 83 is applied to the exterior of the support layer to form the smooth fiat forward surface 80. In a preferred embodiment, the facing layer 83 is magnetized so that it can hold into place a display panel board 30 having matching magnetic strips or ferris material strips. The facing layer 83 can be bifurcated into two parallel strips separated by a groove 85. It has been found that such a configuration assists in the smooth telescoping action of an inner bar within an outer bar. The groove 85 apparently forms a reservoir of air which provides an air cushioning effect as two telescoping bars slide relative to one another.

The third bar 50 is connected to the second bar 14 by a second connection piece 84. Like the first connection piece 16, the second connection piece 84 comprises a forward moiety 86, a rearward moiety 88, a compressible spacer 90 and a catch 92.

The forward moiety 85 of the second connection piece 84 is affixed to the distal end 76 of the third bar 50 and the rearward moiety 88 is displaceably attached to the forward moiety 86. The forward moiety 86 has a first forward surface section 94 disposed flush with the outer surface 80 of the forward wall 78 of the third bar 50 and a second forward surface section 96 disposed distal to the first forward surface section 94 and in a parallel plane with that of the first forward surface section 94 by recessed therefrom by a distance substantially equal to u.

Like the first connection piece 16, the second connection piece 84 comprises a compressible spacer 90 disposed between the forward and rearward moieties 86 and 88 and configured and dimensioned to urge the forward moiety 86 away from the rearward moiety 88. The compressible spacer 90 can be a spring, such as a coil spring. Also like the first connection piece 16, a fastener such as a bolt 91 can be used to hold together the forward moiety 86 to the rearward moiety 88.

The catch 92 of the second connection piece 84 is disposed on the second forward surface section 96 of the second connection piece 84 and is configured and dimensioned to (1) engage the lip 52 on the proximal end 40 of the second bar 14 when the device 10 is telescopically expanded, and (2) not engage the lip 52 on the proximal end 40 of the second bar 14 when the device 10 is telescopically contracted.

Analogous to the interaction of the first bar 12 and the second bar 14, the third bar 50 can be telescopically expanded out of the second bar 14 in such a way that the forward surface 46 of the second bar 14 is flush with both the first forward surface section 94 of the second connection piece 84 and the outer surface of the third bar 50. Also, the third bar 50 can be telescopically contracted into the second bar 14 by depressing the forward moiety 86 of the second connection piece 84 against the force exerted against the compressible spacer 90 in the second connection piece 84 and then sliding the second connection piece 84 and the third bar 50 into the second bar 14.

As shown in the drawings, a pair of panel board attachment projections 98 can be attached to the proximal end of the uppermost bar (the third bar 60 in the embodiments shown in the drawings). These projections 98 facilitate the hanging of panel boards 30 onto the support device 10. In the embodiment shown in the drawings, two panel boards 30, disposed edge-to-edge could be attached to the support device 10, one panel board 30 attached to each projection 98.

The embodiment shown in the drawings comprises three telescoping bars 12, 14, and 50. As few as two bars could be used and several additional bars can also be used. The upper limit on the number of bars will be determined by the strength requirements of the smallest bar.

As shown in FIG. 1, the support device can be used with a collapsible support frame 100 to provide a combination 101 useful for suspending display boards 30. The support frame 100 can be any of the numerous kinds of support frames 100 known in the industry. A support frame 100 useful in the combination is the model support frame manufactured by Professional Displays, Inc. of Covina, Calif.

The support frame 100 is made up of a plurality of vertical struts 102 and horizontal struts 104. The vertical struts 102 are paired to form vertical x-shaped members 106 wherein each vertical strut 102 is pivoted at the center 108 of the x. Likewise, each of the horizontal struts 104 is paired to form a horizontal x-shaped member 110 wherein each of the horizontal struts 104 is pivotable at the center 112 of the x. This configuration allows the frame 100 to be fully collapsed for ease of storage and portability. When the frame 100 is assembled, opposing snap-on corner pieces 114 are engaged to one another to firmly hold the ends of each x-shaped member 106 or 110 in rigid spaced-apart configuration.

For use in the combination 101, each end of the support device 10 and each connection piece has a frame attachment component 116 affixed thereto. Each of the frame attachment components 116 are configured and dimensioned to engage corresponding hubs 120 on the support frames 100.

In the embodiment shown in the drawings, the hubs 120 and the corresponding frame attachment components 116 are configured and dimensioned so that the frame attachment components 116 slidably engage a corresponding hub 120. Preferably, the hubs 120 and the frame attachment components 116 are generally configured so that, when the support device 10 is fully expanded and disposed vertically with the first bar 12 at the bottom, at least all of the attachment components 116 except, perhaps, the attachment component 116 on the proximal end of the uppermost bar, engage corresponding hubs 120 on the support frame 100 by sliding the attachment components 116 downwardly. By this configuration, the weight of the support device 10 is fully supported by the hubs 120.

More preferably, as shown in FIGS. 3*a*, 4*a* and 6*a*, the attachment component 116 on the proximal end of the uppermost bar is configured so that, when the support device 10 is fully expanded and disposed vertically with the first bar 12 at the bottom, the attachment component 116 on the proximal end of the uppermost bar engages a corresponding hub 120 on the support frame 100 by sliding the attachment component 116 on the proximal end of the uppermost bar upwardly. This configuration is preferable where there is a certain amount of "give" in the support frame 100 and/or in the uppermost bar 10. Such "give" allows the uppermost bar to be attached to the support frame 100 by sliding the proximal attachment frame component 116 upwardly and sliding the attachment frame component 116 disposed proximate to the distal end of the uppermost bar downwardly. It has been found that the amount of "give" in most standard support frames 100 is sufficient for this purpose and allows for the uppermost bar to be "snapped" into place on the support frame 100. This configuration provides a very solid attachment of the support device 10 to the support frame 100.

Alternatively, as shown in FIGS. 3*b*, 4*b* and 6*b*, the attachment component 116 on the proximal end of the uppermost bar is configured so that, when the support device 10 is fully expanded and disposed vertically with the first bar 12 at the bottom, the attachment component 116 on the proximal end of the uppermost bar engages a corresponding hub 120 on the support frame 100 by sliding the attachment component 116 on the proximal end of the uppermost bar downwardly (in the same way that the other attachment components 116 attach to corresponding hubs 120).

FIG. 5 illustrates a typical support frame hub having a male engagement wedge 122 directly upward so that a corresponding female engagement slot 124 on a frame attachment component 116 can be slidably engaged with the hub 120 by sliding the frame attachment component 116 downwardly.

FIG. 4*a* illustrates a preferred hub 120 at the top of the support frame 100 having its male engagement wedge 122 directed downwardly so that a corresponding frame attachment component 116 on the proximal end of the uppermost bar can be slidably engaged with the hub 120 by sliding the frame attachment component 116 upwardly.

FIG. 4*b* illustrates a hub 120 at the top of the support frame 100 having its male engagement wedge 122 directed upwardly (similar to the other male engagement wedges 122) so that a corresponding frame attachment component 116 on the proximal end of the uppermost bar can be slideably engaged with the hub 120 by sliding the frame attachment component 116 downwardly.

In operation, the combination 101 illustrated in the drawings, including FIGS. 3*a*, 4*a* and 6*a*, is assembled by fully extending the support frame 100 until corresponding ends of each x-shaped member 106 and 110 are proximate to one another and then locking those ends together by engaging the corner pieces 114. The support device 10 is then telescopically expanded by first snapping into place the frame attachment component 116 on the uppermost bar (the third bar 50 in the embodiment shown in the drawings) and then allowing the other bars 12 and 14 to gravitate downwardly. When the second connection piece 84 is fully withdrawn from the second bar 14, the first forward surface 94 section of the second connection piece 84 snaps forward by the force of the compressible spacer 90 and snaps the second bar 14 flush with the first bar 12. Likewise, when the first connection piece 16 is fully withdrawn from the first bar 12, the first forward surface section 60 of the first connection piece 16 snaps forward by the force of the compressible spacer 64 within the first connection piece 16 and snaps the outer surface 22 of the first bar 12 flush with the outer surfaces 46 and 80 of the second and third bars 14 and 50. As the second and first bars 14 and 12 gravitate downwardly, the frame attachment components 116 on each bar slidably engage corresponding hubs 120 on the support frame 100.

Thus, the support device 10 can be attached to the support frame 100 simply and quickly. The uppermost bar is snapped into place and the other bars all but automatically gravitate into place.

After the each of the support devices 10 is attached to the support frame 100, the panel boards 30 are attached to the support devices 10 via the attachment projections 98 and the interaction of magnetic strips (not shown) on the backside of the panel boards 30 with the magnetic facing layer 34 on the forward surfaces of the bars. The display module is then fully assembled.

The display module can be disassembled by reversing the assembly steps set forth above. The panel boards 30 are removed. The support device 10 is telescopically contracted by first depressing the first forward surface section 60 of the first connection device 16 against the force of the compressible spacer 64 and then sliding the first bar 12 over the second bar 14. After this is accomplished, the first forward surface section 94 of the second connection piece 84 is depressed against the force of the compressible spacer 90 within the second connection piece 84 and the second bar 14 is slid upwardly over the third bar 50. After this is accomplished, the display frame 100 is slightly flexed and the third bar 50 is de-attached from the display frame 100. As can be seen from FIG. 7, the support device 10 can be telescopically contracted into a compact unit which is essentially no longer than the first bar 12.

In operation, the alternative combination 101 illustrated in the drawings, including FIGS. 3*b*, 4*b* and 6*b*, is assembled by fully extending the support frame 100 until corresponding ends of each x-shaped member 102 and 110 are proximate to one another, and then locking those ends together by engaging the corner pieces 114. The support device 10 is then telescopically expanded by first sliding into place the attachment frame component 116 on the uppermost bar (the third bar 50 in the embodiment shown in the drawings) and then allowing the other bars 12 and 14 to gravitate downwardly. Like with the combination 101 illustrated in the drawings, including FIGS. 3*a*, 4*a* and 6*a* (discussed above), when the second connection piece 84 is fully withdrawn from the second bar 14, the first forward surface 94 section of the second connection piece 84 snaps forward by the force of the compressible spacer 90 and snaps the second bar 14 flush with the first bar 12. Likewise, when the first connection piece 16 is fully withdrawn from the first bar 12, the first forward surface section 60 of the first connection piece 16 snaps forward by the force of the compressible spacer 64 within the first connection piece 16 and snaps the outer surface 22 of the first bar 12 flush with the outer surfaces 46 and 80 of the second and third bars 14 and 50. As the second and first bars 14 and 12 gravitate downwardly, the frame attachment components 116 on each bar slideably engage corresponding hubs 120 on the support frame 100.

Although the present invention has been described in considerable detail with reference to certain preferred versions, many other versions should be apparent to those skilled in the art. Therefore, the spirit and scope of the appending claims should not necessarily be limited to the description of the preferred versions contained herein.

What is claimed is:

1. A support device comprising:

(a) an elongate first bar having a proximal end, a distal end, a forward wall with a flat outer surface and a thickness t, a pair of opposing sidewalls, and a lip disposed on the proximal end;

(b) an elongate second bar configured and dimensioned to be slidably disposed and retained within the first bar, the second bar having a proximal end, a distal end, a forward wall with a flat outer surface and a pair of opposing side walls; and (c) a first connection piece attached to the distal end of the second bar comprising:

(i) a forward moiety affixed to the distal end of the second bar and a rearward moiety displaceably attached to the rearward moiety, the forward moiety having a first forward surface section disposed flush with the outer surface of the forward wall of the second bar and a second forward surface section disposed distal to the first forward surface section and in a parallel plane with that of the first forward surface section but recessed therefrom by a distance substantially equal to t;

(ii) a compressible spacer disposed between the forward and rearward moieties and configured and dimensioned to urge the forward moiety away from the rearward moiety; and (iii) a catch disposed on the second forward surface section, the catch being configured and dimensioned to (I) engage the lip on the proximal end of the first bar when the device is telescopically expanded, and (II) not engage the lip on the proximal end of the first bar when the device is telescopically contracted;

so that the second bar can be telescopically expanded out of the first bar in such a way that the outer surface of the forward wall in the first bar is flush with both the first forward surface section of the first connection piece and the outer surface of the forward wall in the second bar; and so that the second bar can be telescopically contracted into the first bar by depressing the forward moiety of the first connection piece against the force exerted by the compressible spacer and then sliding the first connection piece and the second bar into the first bar.

2. The support device of claim 1 wherein the second bar has a lip disposed on the proximal end of the second bar, the forward wall of the second bar has a thickness u and the support device further comprises:

(a) an elongate third bar configured and dimensioned to be slidably disposed and retained within the second bar, the third bar having a proximal end, a distal end, a forward wall with a flat outer surface, and a pair of opposing side walls;

(b) a second connection piece attached to the distal end of the third bar comprising:

(i) a rearward moiety affixed to the distal end of the third bar and a rearward moiety displaceably attached to the rearward moiety of the second connection piece, the forward moiety of the second connection piece having a first forward surface section disposed flush with the outer surface of the forward wall of the third bar and a second forward surface section disposed distal to the first forward surface section of the second connection piece and in a parallel plane with that of the first forward surface section of the second connection piece but recessed therefrom by a distance substantially equal to u;

(ii) a compressible spacer disposed between the forward and rearward moieties of the second connection piece and configured and dimensioned to urge the forward moiety of the second connection piece away from the rearward moiety of the second connection piece; and (iii) a catch disposed on the second forward surface section of the second connection piece and being configured and dimensioned to (I) engage the lip on the proximal end of the second bar when the device is telescopically expanded, and (II) not engage the lip on the proximal end of the second bar when the device is telescopically contracted;

so that the third bar can be telescopically expanded out of the second bar in such a way that the forward surface of the second bar is flush with both the first forward surface section of the second connection piece and the forward surface of the third bar; and so that the third bar can be telescopically contracted into the second bar by depressing the forward moiety of the second connection piece against the force exerted by the compressible spacer in the second connection piece and then sliding the second connection piece and the third bar into the second bar.

3. The support device of claim 1 wherein the catch is a flange having a tapered distal edge and an engageable proximal edge.

4. The support device of claim 1 wherein the compressible spacer is a spring.

5. The support device of claim 1 wherein the lip is provided by an aperture in the forward wall of the first bar.

6. The support device of claim 1 further comprising a plurality of frame attachment components affixed spaced apart along the support device.

7. The support device of claim 6 wherein the frame attachment components are configured and dimensioned to slidably engage corresponding hubs on a support frame.

8. The support device of claim 7 wherein the frame attachment components are configured so that, when the support device is fully expanded and disposed vertically with the first bar at the bottom, all of the attachment components engage corresponding hubs on the support frame by sliding the attachment components downwardly.

9. The support device of claim 7 wherein the frame attachment components are configured so that, when the support device is fully expanded and disposed vertically with the first bar at the bottom, at least all of the attachment components, except an attachment component on the proximal end of the uppermost bar, engage corresponding hubs on the support frame by sliding the attachment components downwardly, and wherein the attachment component on the proximal end of the uppermost bar is configured so that, when the support device is fully expanded and disposed vertically with the first bar at the bottom, the attachment component on the proximal end of the uppermost bar engages a corresponding hub on the support frame by sliding the attachment component on the proximal end of the uppermost bar upwardly.

10. The support device of claim 9 wherein the attachment components on the uppermost bar are spaced apart in such a way that the uppermost bar can be snapped onto the support frame.

11. A support frame and support device combination comprising at least one support device attached to a support frame wherein the support device comprises:

(a) an elongate first bar having a proximal end, a distal end, a forward wall with a flat outer surface and a thickness t, a pair of opposing sidewalls, and a lip disposed on the proximal end;

(b) an elongate second bar configured and dimensioned to be slidably disposed and retained within the first bar, the second bar having a proximal end, a distal end, a forward wall with a flat outer surface and a thickness u, a pair of opposing side walls and a lip disposed on the proximal end of the second bar;

(c) a first connection piece attached to the distal end of the second bar comprising:

(i) a forward moiety affixed to the distal end of the second bar and a rearward moiety displaceably attached to the rearward moiety, the forward moiety having a first forward surface section disposed flush with the outer surface of the forward wall of the second bar and a second forward surface section disposed distal to the first forward surface section and in a parallel plane with that of the first forward surface section but recessed therefrom by a distance substantially equal to t;

(ii) a compressible spacer disposed between the forward and rearward moieties and configured and dimensioned to urge the forward moiety away from the rearward moiety; and (iii) a catch disposed on the second forward surface section, the catch being configured and dimensioned to (I) engage the lip on the proximal end of the first bar when the device is telescopically expanded, and (II) not engage the lip on the proximal end of the first bar when the device is telescopically contracted;

so that the second bar can be telescopically expanded out of the first bar in such a way that the outer surface of the forward wall in the first bar is flush with both the first forward surface section of the first connection piece and the outer surface of the forward wall in the second bar; and so that the second bar can be telescopically contracted into the first bar by depressing the forward moiety of the first connection piece against the force exerted by the compressible spacer and then sliding the first connection piece and the second bar into the first bar; and (d) a plurality of frame attachment components affixed spaced apart along the support device;

wherein the frame support has a plurality of spaced apart hubs and wherein each of the frame attachment components is engaged to a corresponding hub.

12. The combination of claim 11 further comprising at least one additional support device attached to the support frame in parallel with, and spaced apart from, the other support device.

13. The combination of claim 11 further comprising at least one panel board attached to the support device.

14. The support device of claim 11 wherein the frame attachment components are configured so that, when the support device is fully expanded and disposed vertically with the first bar at the bottom, all of the attachment components engage corresponding hubs on the support frame by sliding the attachment components downwardly.

15. The support device of claim 11 wherein the frame attachment components are configured so that, when the support device is fully expanded and disposed vertically with the first bar at the bottom, at least all of the attachment components, except an attachment component on the proximal end of the uppermost bar, engage corresponding hubs on the support frame by sliding the attachment components downwardly, and wherein the attachment component on the proximal end of the uppermost bar is configured so that, when the support device is fully expanded and disposed vertically with the first bar at the bottom, the attachment component on the proximal end of the uppermost bar engages a corresponding hub on the support frame by sliding the attachment component on the proximal end of the uppermost bar upwardly.

16. A display board combination comprising a support frame having a plurality of spaced-apart hubs disposed in two vertical rows, a pair of spaced-apart, vertically disposed support devices attached to the support frame and a display board attached to the support devices, wherein each support device comprises:

(a) an elongate first bar having a proximal end, a distal end, a forward wall with a flat outer surface and a thickness t, a pair of opposing sidewalls, and a lip disposed on the proximal end;

(b) an elongate second bar configured and dimensioned to be slidably disposed and retained within the first bar, the second bar having a proximal end, a distal end, a forward wall with a flat outer surface and a thickness u, a pair of opposing side walls and a lip disposed on the proximal end of the second bar;

(c) a first connection piece attached to the distal end of the second bar comprising:

(i) a forward moiety affixed to the distal end of the second bar and a rearward moiety displaceably attached to the rearward moiety, the forward moiety having a first forward surface section disposed flush with the outer surface of the forward wall of the second bar and a second forward surface section disposed distal to the first forward surface section and in a parallel plane with that of the first forward surface section but recessed therefrom by a distance substantially equal to t;

(ii) a spring disposed between the forward and rearward moieties and configured and dimensioned to urge the forward moiety away from the rearward moiety; and (iii) a catch disposed on the second forward surface section, the catch being configured and dimensioned to (I) engage the lip on the proximal end of the first bar when the device is telescopically expanded, and (II) not engage the lip on the proximal end of the first bar when the device is telescopically contracted;

so that the second bar can be telescopically expanded out of the first bar in such a way that the outer surface of the forward wall in the first bar is flush with both the first forward surface section of the first connection piece and the forward wall in the outer surface of the second bar; and so that the second bar can be telescopically contracted into the first bar by depressing the forward moiety of the first connection piece against the force exerted by the spring and then sliding the first connection piece and the second bar into the first bar;

(d) an elongate third bar configured and dimensioned to be slidably disposed and retained within the second bar, the third bar having a proximal end, a distal end, a forward wall with a flat outer surface, and a pair of opposing side walls;

(e) a second connection piece attached to the distal end of the third bar comprising:

(i) a forward moiety affixed to the distal end of the third bar and a rearward moiety displaceably attached to the rearward moiety of the second connection piece, the forward moiety of the second connection piece having a first forward surface section disposed flush with the outer surface of the forward wall of the third bar and a second forward surface section disposed distal to the first forward surface section of the second connection piece and in a parallel plane with that of the first forward surface section of the second connection piece but recessed therefrom by a distance substantially equal to u;

(ii) a spring disposed between the forward and rearward moieties of the second connection piece and configured and dimensioned to urge the forward moiety of the second connection piece away from the rearward moiety of the second connection piece; and (iii) a catch disposed on the second forward surface section of the second connection piece and being configured and dimensioned to (I) engage the lip on the proximal end of the second bar when the device is telescopically expanded, and (II) not engage the lip on the proximal end of the second bar when the device is telescopically contracted;

so that the third bar can be telescopically expanded out of the second bar in such a way that the outer surface of the forward wall in the second bar is flush with both the first forward surface section of the second connection piece and the outer surface of the forward wall in the third bar; and so that the third bar can be telescopically contracted into the second bar by depressing the forward moiety of the second connection piece against the force exerted by the spring in the second connection piece and then sliding the second connection piece and the third bar into the second bar; and (f) a plurality of frame attachment components affixed spaced apart along the support device, each of the frame attachment components being slidably engaged to a corresponding hub on the support frame.

17. The combination of claim 16 wherein the frame attachment components are configured so that, when each support device is disposed vertically with the first bar at the bottom, all of the attachment components on that support device engage corresponding hubs on the support frame by sliding the attachment components downwardly.

18. The combination of claim 16 wherein the frame attachment components are configured so that, when each support device is disposed vertically with the first bar at the bottom, at least all of the attachment components on that support device, except an attachment component on the proximal end of the uppermost bar, engage corresponding hubs on the support frame by sliding the attachment components downwardly.

19. The combination of claim 18 wherein the attachment component on the proximal end of the uppermost bar in each support device is configured so that, when that support device is disposed vertically with the first bar at the bottom, the attachment component on the proximal end of the uppermost bar engages a corresponding hub on the support frame by sliding the attachment component on the proximal end of the uppermost bar upwardly.

20. The combination of claim 19 wherein the attachment components on the uppermost bar of each support device are spaced apart in such a way that each uppermost bar can be snapped onto the support frame.

* * * * *